United States Patent [19]

Brandl et al.

[11] Patent Number: 4,694,496

[45] Date of Patent: Sep. 15, 1987

[54] CIRCUIT FOR ELECTRONIC SPEECH SYNTHESIS

[75] Inventors: Hans Brandl; Werner Liegl, both of Munich, Fed. Rep. of Germany

[73] Assignee: Siemens Aktiengesellschaft, Berlin and Munich, Fed. Rep. of Germany

[21] Appl. No.: 491,581

[22] Filed: May 4, 1983

[30] Foreign Application Priority Data

May 18, 1982 [DE] Fed. Rep. of Germany ..... 3218755

[51] Int. Cl.[4] ..... G10L 5/00

[52] U.S. Cl. ..... 381/51

[58] Field of Search ..... 381/51; 364/825, 724; 84/1.19

[56] References Cited

U.S. PATENT DOCUMENTS

| | | | |
|---|---|---|---|
| 2,060,321 | 11/1936 | Asada et al. | 381/51 |
| 2,121,142 | 6/1938 | Dudley | 381/51 |
| 2,194,298 | 3/1940 | Dudley | 381/51 |
| 2,881,257 | 4/1959 | Weibel | 381/51 |
| 3,624,301 | 11/1971 | Richeson | 381/51 |
| 3,836,717 | 9/1974 | Gagnon | 381/51 |
| 3,997,973 | 12/1976 | Buss | 364/825 |
| 4,236,434 | 12/1980 | Nishibe | 381/51 |
| 4,454,609 | 6/1984 | Kates | 381/68 |
| 4,475,228 | 10/1984 | Vickers | 381/51 |

OTHER PUBLICATIONS

"Talk to Computers," Baumann, Elektor, vol. 7, No. 5, pp. 17–19.

"Speech Syntheses by Linear Interpolation of Spectral Parameters Between Dyad Boundaries," Shadle et al, J. Acoust. Soc. Am 66(5), Nov. 1979, pp. 1325–1332.

"Aspects of Formant Speech Synthesis," Sapozhkov, Telecom. and Radio Eng., vol. 25/26, No. 3, Mar. 1971, pp. 4–13.

"Speech Analysis Synthesis and Perception", (2nd Edition), Flanagan, 1972, pp. 339–348, 367–370, 390–395.

*Primary Examiner*—Gareth D. Shaw

*Assistant Examiner*—John G. Mills

*Attorney, Agent, or Firm*—Hill, Van Santen, Steadman & Simpson

[57] ABSTRACT

A circuit for electronically synthesizing speech has an audio generator for representing voiced sounds and a noise generator for representing voiceless sounds and a means for selecting significant parameters of the various speech elements by sampling and a means for storing those parameters. The circuit also includes a filter unit comprised of a number of individual filters and a means for selectively driving only those individual filters having filter coefficients necessary for representing the significant parameters of the particular speech element to be synthesized. The filters can be utilized individually or combined into selected groups in order to generate longer speech segments. The electronic signal at the output of the filter unit is edited for acoustically reproducing the desired speech elements and segments.

13 Claims, 4 Drawing Figures

CIRCUIT FOR ELECTRONIC SPEECH SYNTHESIS

BACKGROUND OF THE INVENTION

1. Field of the invention

The present invention relates to circuits for synthesizing speech electronically, and in particular to such circuits wherein speech elements are represented by significant components and individual speech elements can be combined into longer speech segments.

2. Description of the Prior Art

Conventional methods for synthetically generating speech elements which may be combined for forming longer speech segments can be generally classified in two groups. The first group includes methods wherein the speech elements are subjected to sampling, the sampling results are converted into digital signals, and are stored in a read only memory from where the sampling results are retrieved (and possibly combined) for speech synthesis. In methods of this type, redundant components of the speech elements which are not necessary for comprehension of the speech elements are also stored, in order to generate a high quality speech reproduction. This requires, however, a correspondingly high storage capacity for representation of such an extensive vocabulary.

The second group of speech synthesizing methods employs substantially the same steps as the methods in the first group, however, redundant speech components are largely supressed and the speech is stored in the form of only significant parameters for each speech element. The speech elements or segments subsequently generated by methods in the second group can nonetheless be comprehended by a listener and moreover can be generated with the need for a significantly lower storage capacity than devices operating according to the first method.

The core of conventional circuits for executing speech synthesis methods in the second group is a filter circuit having variable filter coefficients. Such a speech synthesis circuit is described, for example, in German AS No. 2209548 wherein an excitation signal including significant speech parameters is supplied to a filter circuit having variable filter coefficients. These filter coefficients are continuously controlled by means of further significant speech parameters during the entire synthesis operation, so that this circuit must exhibit devices for precisely storing these filter coefficients. Moreover, this conventional circuit must be equipped with control devices for retrieving the coefficients from the memory and for supplying the coefficients to the filters. Such tunable filters thus require relatively large dimensions and can be realized only with significant circuit outlay and close attention to narrow tolerances required for good speech quality.

SUMMARY OF THE INVENTION

It is an object of the present invention to provide a circuit for electronic speech synthesis which generates synthetic speech which is easily comprehensable which requires only a low storage capacity and which utilizes simply realizable filters with fixed coefficients.

The above object is inventably achieved in a speech synthesis circuit having a filter unit consisting of a plurality of individual filters, of which only those particular filters having fixed filter coefficients necessary for representing the significant parameters of the speech elements are sequentially driven by a control unit.

The individual filters may be constructed as analog filters supplied with a time-discrete analog excitation signal. The circuitry necessary for constructing such analog filters is relatively simple, particularly in a further embodiment of the invention wherein the filters are in the form of transversal filters constructed in accordance with charge coupled device (CCD) technology.

The individual filters may be digital filters which are also supplied with a time-discrete excitation signal in digital form, this embodiment offering the advantage of being able to store the parameter values for the speech signals in a particularly simple manner.

In a further embodiment of the invention, the individual filters for representing speech elements can be addressed filter-by-filter. A circuit constructed in accordance with the principles disclosed and claimed herein may include a plurality of individual filters for representing all phonemes of a specific language. A plurality of phonemes may be generated in a specific chronological sequence, and connected to one another in accordance with the characteristics of the human voice.

Another embodiment of the invention employs individual filters which are interconnected in filter groups for representing longer speech segments. In this embodiment, a random access drive of the filter groups is achieved by means of filter group-by-filter group addressing. This embodiment exhibits a particularly low memory outlay and is suitable for representing speech in which identical speech segments repeatedly occur. The individual filters may also be arranged in a matrix in which the individual filters of one matrix row are supplied with an excitation signal in parallel and the individual filter outputs of a respective matrix row are sequentially connected to the output of the overall matrix.

Another embodiment of the invention utilizes individual filters in the form of linear prediction filters of the type known to those skilled in the art. The individual filters may also be format filters exhibiting a fixed formant center frequency and bandwidths as are also known in the art. Representation of speech elements in this embodiment is achieved by reproducing at least the three lowest formant.

DESCRIPTIONS OF THE DRAWINGS

DESCRIPTION OF THE PREFERRED EMBODIMENTS

Figure 1:
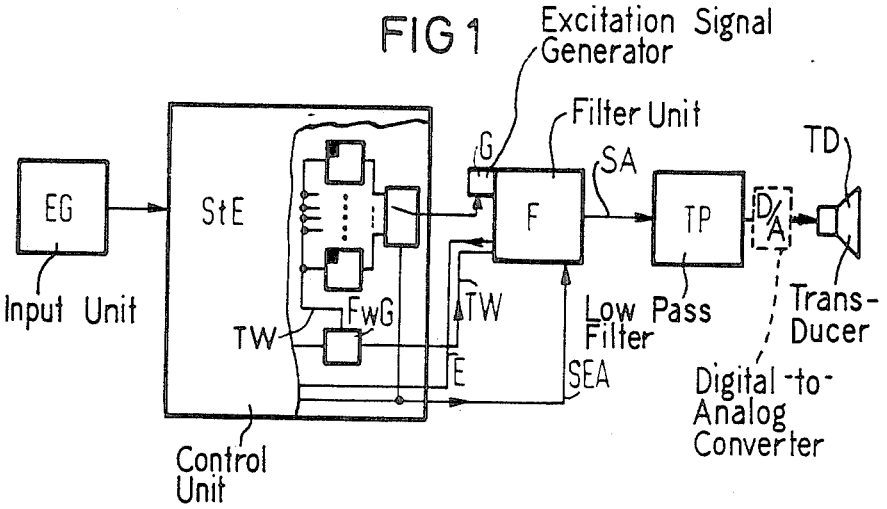
FIG. 1 is a block diagram of a circuit for speech synthesis constructed in accordance with the principles of the present invention.

A schematic block diagram of a speech synthesis circuit constructed in accordance with the principles of the present invention is shown in FIG. 1. The circuit includes an input unit EG supplying a signal to a control unit StE which controls the operation of a filter unit F. The filter unit F is supplied with excitation signals from an excitation signal generator G, which is also controlled by the control unit StE. The filter unit F generates an output signal SA which is supplied to a low pass filter TP. The output of the low pass filter TP is supplied to an electro-acoustical transducer TD, such as a speaker.

Speech elements to be synthesized are supplied to the control unit StE via the input unit EG which may, for example, be a key board. As will be apparent to those skilled in the art, information concerning speech elements to be synthesized may be supplied by any number of external devices suitably interfaced with the circuit disclosed and claimed herein. The control unit StE may include means for intermediate storage of the information and for supplying the information to the filter unit F in the so-called "handshake" mode, as well as memories in which speech parameters are stored. Further details of the control unit StE and its interaction with the filter unit F are described in detail below in connection with FIG. 2. As shown in FIG. 1, the control unit StE supplies a change of filter clock signal TW via a signal line to the filter unit F, and also supplies a digital speech element selection signal SEA via nothe signal line. The change of filter clock signal TW controls synthesis of that speech element in the filter unit F which is determined by the speech elements selection signal SEA.

The filter unit F, described in greater detail in connection with FIG. 2, has a number of individual filters with fixed coefficients. Speech synthesis is executed by means of these individual filters, the individual filters generating an electrical speech signal which forms the output SA of the filter unit F. The signal SA (which may be subjected, if necessary, to digital-to-analog conversion in a converter D/A) is supplied to the low pass filter TP and to the transducer TD. If necessary, an amplifier may be interconnected between the low pass filter TP and the transducer TD. As also shown in FIG. 1, the filter unit F supplies a digital signal E via a control line to the control unit StE. The digital signal E indicates the end of the synthesis process for a particular speech element and, in the handshake mode, requests the necessary information for the synthesis process for the following speech element determined by the input information.

Figure 2:
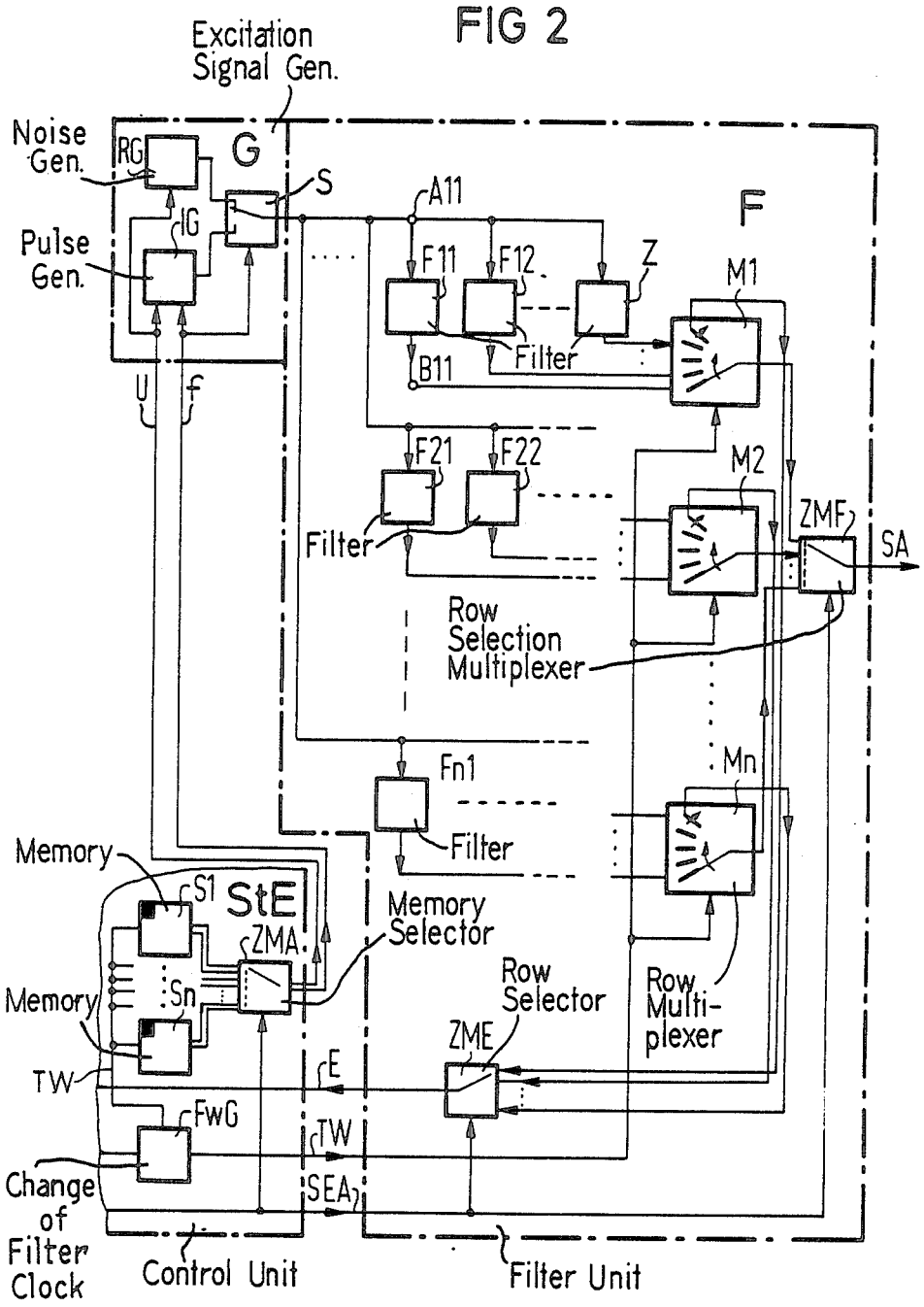
FIG. 2 is a block diagram showing details of various components of FIG. 1 with a filter unit having individual filters arranged in a matrix.

As shown in FIG. 2, a plurality of individual filters are arranged in a matrix in the filter unit F. The individual filters are disclosed in columns (F11, F21, . . . Fn1) and rows (F11, F12, . . . F1z). Each row has a multiplexer M1, M2, . . . Mn, each of which is connected to a row selection multiplexer ZMF. The filter unit F also has a row selector ZME connected to each of the multiplexers M1, . . . Mn. If necessary, a so-called "time window" circuit (not shown) may be interconnected between the excitation signal generator G and the individual filters.

As further shown in FIG. 2, the excitation signal generator G consists of a controllable pulse generator IG and a controllable noise generator RG, each of which are connected to the filter rows in the matrix through a switching element S. The control unit StE includes, inter alia, memories S1, . . . Sn in which speech parameter values are stored. The control unit StE also includes a change of filter clock FwG and a memory selector ZMA. The filter unit F is supplied with the change of filter clock pulse signal TW and the speech element selection signal SEA from the control unit StE. The change of filter clock generator FwG generates equal distant change of filter clock pulses TW having a period which may be, for example, between ten and twenty-five milliseconds. The change of filter clock pulses TW are simultaneously supplied to all row-associated multiplexers M1, . . . Mn in the filter unit F and all of the memories S1, . . . Sn in the control unit StE. In the embodiments shown in FIG. 2, the number of multiplexer M1, . . . Mn is equal to the number of memories S1, . . . Sn. This number corresponds to the number of rows in the filter matrix.

If, for example, n different speech segments are to be generated by the filter unit F, the filter unit F will require n filter groups disposed in rows. Each filter group is comprises of at least one individual filter. The speech segment generated by the filter group consists of a plurality of speech elements which are individually generated by the filters comprising the filter groups. If the duration of a speech element is TW (i.e., the duration of the filter clock pulse) the duration of a speech segment comprised of m speech elements will be m . TW. The number of individual filters required for generating such a speech segment may be smaller than m when the particular speech segment contains a number of identical speech elements which are synthesized in identical individual filters in the group. The analog speech element signals are interconnected by means of the respective row-associated multiplexer to form the analog output speech signal SA under the control of the change of filter clock signal TW. The pulse sequence (having a frequency 1/TW) generated by the change of filter clock generator FwG is also supplied to all of the row-associated memories S1, . . . Sn in the control unit StE, in which the parameter values of the excitation signals such as, for example, their frequency f and amplitude U, are stored. As a result of the pulse sequence generated by the change of filter clock generator FwG, these parameters are retrieved from the memories S1, . . . Sn and are supplied to the memory selector ZMA. Based on the measure of the speech element selection signal SEA also supplied to the memory selector ZMA, the memory selector ZMA selects the parameter values for the speech segment to be generated and forwards those values to the excitation signal generator G. The pulse generator IG in the excitation signal generator G is controllable in frequency and amplitude and the noise generator RG is controllable in amplitude only. The switch element S is frequency controlled on the basis of the information called from the memories S1, . . . Sn. For frequency values f equal to zero, the noise generator RG is connected to the filter unit F, and for frequency values f unequal to zero, the pulse generator IG is connected to the filter unit F. Depending upon the values f and U, the excitation signal generator G supplies pulse or noise signals of a specific amplitude and, if necessary, frequency. Voiceless speech elements are simulated by means of noise signals and voiced speech elements of a specific frequency are simulated by pulse sequences of precisely this frequency.

The excitation signals generated by the excitation signal generator G are supplied to all of the filter groups, including those which are not necessary for generating the selected speech segment as well as those which are necessary. All analog signals generated in the filter groups are supplied through the multiplexers M1, . . . Mn to the row selection multiplexer ZMF in which the desired speech signal is then selected by means of the speech element selection signal SEA, the output of the row selection multiplexer ZMF thus forming the output SA for the filter unit F.

The speech signal SA is supplied to the low pass filter TP which filters out higher frequency components contained in the speech signal caused by, for instance, the pulse-like excitation of the filters.

It will be understood by those skilled in the art that the above description is not limited to speech synthesis by means of analog filters supplied with analog excitation signals, but also applies to speech synthesis by means of digital filters supplied with digital excitation signals, in which case the output signal SA is subjected to a digital-to-analog conversion. The output of the low pass filter TP is then supplied, with amplification if necessary, to the transducer TD.

Simultaneously with the connection of the last speech element generated in the particular filter group to the row-associated multiplexers M1, . . . Mn, those multiplexers forward a digital signal E to the row selector ZME, identifying the chronological conclusion of the speech synthesis event in the filter group. The row selector ZME is in a switching position controlled by the speech element selection signal SEA and through-connects the digital signal E to the control unit StE, which thus initiates the synthesis process for the next speech segment.

The individual filters shown in FIG. 2 having fixed coefficients can also be individually addressable, rather than in groups. In such an embodiment, the filter unit F will not require a row selection multiplexer or a row selector, nor will it require row-associated multiplexers as described above in connection with FIG. 2. In the individually addressable embodiment, the control unit StE includes means for storing individually addressable parameter values for the excitation signals and for interconnecting the speech element signals generatable in the individual filters. The change of filter clock FwG and the excitation signal generator G (if necessary, with a time window circuit) perform the same functions described in the above embodiment. The individually addressable embodiment utilizes a random access drive of the individual filters by means of individual filter addressing and thus requires only different individual filters, whereas the embodiment shown in FIG. 2 may include identical individual filters in the various filter groups and may also require identical filters to be disposed in the same filter group. The latter embodiment, which can be realized with smaller technical outlay because of the filter group addressing in comparison to the individual filter addressing, is particularly suited for reproducing speech which contains repeated identical speech segments. Another embodiment may be realized containing both individual filters combined in filter groups as well as independent individually addressable filters. A number of individual filters utilized can be optimized in this manner.

Figure 3:
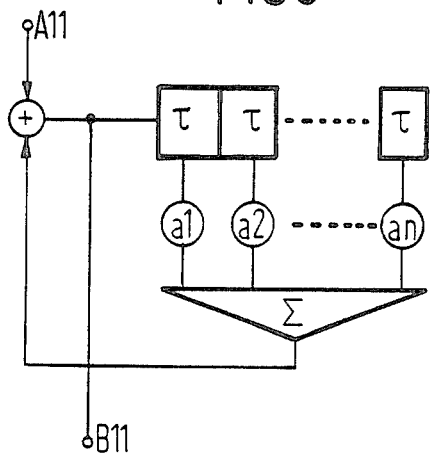
FIG. 3 is a schematic block diagram of a linear prediction filter suitable for use as an individual filter in the matrix of FIG. 2.

The individual filters comprising the filters in the matrix shown in FIG. 2 may be linear prediction filters having fixed coefficients, as shown in FIG. 3. Linear prediction is known in the art as described, for example, in "Speech Analysis Synthesis and Perception," Flanagan, 1972 at pages 367–390. The attainable speech quality is, within certain limits, proportional to the number of the coefficients. Good speech quality can be realized with approximately ten filter coefficients. The prediction filter shown in FIG. 3 having coefficients $\tau$ connected via terminals al, . . . an to a summing amplifier $\Sigma$ can be connected at terminals A11 and B11 to the corresponding terminals shown in FIG. 2. The linear prediction filters may be analog or digital filters. The excitation signal generator G will supply the filters with excitation signals in analog or digital form as needed, and analog or digital signals accordingly are generated at the filter outputs.

Figure 4:
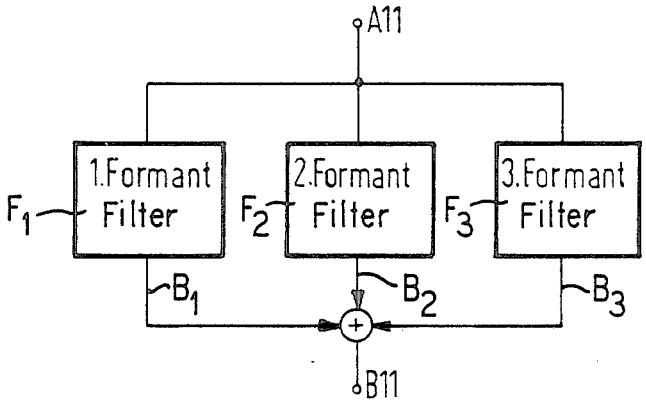
FIG. 4 is a schematic block diagram of formant filters suitable for use as the individual filters in the matrix of FIG. 2.

Another filter means which may be utilized as the individual filters in FIG. 2 are so-called formant filters having fixed filter coefficients. As shown in FIG. 4 a parallel connection to three formant filters $F_1$, $F_2$, and $F_3$ may be utilized to correspond to each individual filter shown in FIG. 2 for simulating at least the first three low frequency speech formants $B_1$, $B_2$, and $B_3$. Speech generation by means of formant synthesis is known to those skilled in the art as described, for example, in the above cited text by Flanagan at page 339. The formant filters $F_1$, $F_2$, and $F_3$ are preferably band pass filters with band pass ranges and center frequencies for those ranges. Such filters can also be realized in analog or digital technology.

In all of the embodiments discussed above, the individual filters may be realized utilizing CCD technology. Transversal filters or recursive filters are utilized, the excitation signal is supplied to the individual filters in time-discrete form. For this purpose, the filter unit F may include a time window circuit not illustrated in detail in FIG. 2. Corresponding to the sampling theorem, the time window circuit may generate a sampling signal having a fixed frequency which is at least twice the frequency of the network signal to be sample. The controllable excitation signal generator G as well as the individual filters in the filter unit F are supplied with the sampling signal thus generated as a clock signal.

Although modifications and changes may be suggested by those skilled in the art it is the intention of the inventors to embody within the patent warranted hereon all changes and modifications as reasonably and properly come within the scope of their contribution to the art.

We claim as our invention:

1. In a circuit for electronic speech synthesis having a means for sampling speech elements and representing said speech elements by a plurality of significant parameters, an excitation signal generating means for generating a pulse excitation signal based on a portion of said significant parameters for representing voiced sounds and for generating a noise signal for representing voiceless sounds, a means for combining a plurality of speech elements into longer speech segments, and an electro-acoustical transducer, the improvement comprising:

a filter unit connected to said excitation signal generating means and to said transducer having a plurality of individual filters each having a fixed filter coefficient, said filter unit generating an electrical speech signal which is supplied to said transducer for conversion into an audio speech signal, said individual filters being arranged in a matrix having rows and columns and each row of said individual filters constituting a filter group; and control means connected to said excitation signal generating means and to said filter unit for selectively driving only those individual filters in said filter unit needed for representing a remainder of said plurality of significant parameters of said speech elements, the individual filters in a selected matrix row being supplied in parallel with said excitation signals from said excitation signal generating means to a matrix output; and means for sequentially connecting the outputs of the individual filters in said selected matrix row to said matrix output.

2. The improvement of claim 1 wherein said individual filters are analog filters and wherein said excitation signals supplied by said excitation signal generating means are time-discrete analog excitation signals.

3. The improvement of claim 1 wherein said individual filters are digital filters and wherein said excitation signals supplied by said excitation signal generating means are time-discrete digital excitation signals, and further comprising a digital to analog conversion means interconnected between said filter unit and said transducer.

4. The improvement of claim 1 wherein said control means undertakes a random access drive of said individual filters by individual filter addressing.

5. The improvement of claim 1 wherein said means for sequentially connecting the filter outputs in a selected matrix row to said matrix output is a row selection multiplexer controlled by said control unit and connected to said matrix output for selecting a matrix row such that the outputs of said matrix row serve as the output for said filter unit.

6. The improvement of claim 5 wherein said means for sequentially connecting the outputs of a selected matrix row to said matrix output is a plurality of row selection multiplexers respectively associated with each matrix row, each multiplexer having a plurality of inputs connected to the outputs of the individual filters in a row, and a change of filter clock in said control unit connected to each of said multiplexers for sequentially selecting one of said multiplexers for connection to said matrix output.

7. The improvement of claim 1 further comprising a plurality of memories in said control unit respectively associated with each of said filter groups, each memory having parameters for the excitation signal for representing a speech segment stored therein.

8. The improvement of claim 7 further comprising a memory selector in said control unit interconnected between each of said memories and said excitation signal generating means, and controlled by a control signal for selectively supplying said parameters for a speech segment to said excitation signal generating means.

9. The improvement of claim 7 wherein one of said parameters is frequency, and wherein said excitation signal generating means includes a switching means interconnected between said filter unit and said pulsed excitation signal generating means and said noise signal generating means, said switching means connecting said noise generating means to said filter unit if said frequency is zero and connecting said pulsed excitation signal generating means to said filter unit if said frequency is unequal to zero.

10. The improvement of claim 4 wherein said individual filters are linear predictive filters.

11. The improvement of claim 4 wherein said individual filters are formant filters each having a fixed formant center frequency and bandwidth coefficients for generating speech signals by reproducing at least the three lowest formants.

12. The improvement of claim 4 wherein said individual filters are comprised of charge coupled devices.

13. The improvement of claim 4 wherein said individual filters are transversal filters.

* * * * *